US006606825B2

(12) United States Patent
Lee et al.

(10) Patent No.: US 6,606,825 B2
(45) Date of Patent: Aug. 19, 2003

(54) WINDOW OPENING AND CLOSING ASSEMBLY

(75) Inventors: Jang-Woo Lee, Seoul (KR); Gi-Won Lee, Chungchongbuk-do (KR); Ho-Sang Lee, Chungchongbuk-do (KR)

(73) Assignee: 3G Technology Co., Ltd. (KR)

( * ) Notice: Subject to any disclaimer, the term of this patent is extended or adjusted under 35 U.S.C. 154(b) by 0 days.

(21) Appl. No.: 10/028,185

(22) Filed: Dec. 20, 2001

(65) Prior Publication Data

US 2002/0078630 A1 Jun. 27, 2002

(30) Foreign Application Priority Data

Dec. 22, 2000 (KR) ..... 2000-0080190

(51) Int. Cl.[7] ..... E05F 11/24; G05G 1/00

(52) U.S. Cl. ..... 49/342; 49/339; 74/89.16; 74/545

(58) Field of Search ..... 49/342, 341, 339, 49/343, 246, 344, 345; 74/543–547, 89.14, 89.16–89.18, 606 R, 545; 16/110 R, 110.5, DIG. 24

(56) References Cited

U.S. PATENT DOCUMENTS 4,305,228 A * 12/1981 Nelson ..... 49/342 X
5,097,629 A * 3/1992 Guhl et al. ..... 49/386
RE34,230 E * 4/1993 Tucker et al. ..... 49/279
5,531,045 A * 7/1996 Piltingsrud ..... 49/279
5,531,138 A * 7/1996 Vetter ..... 74/606 R
5,590,491 A * 1/1997 Piltingsrud ..... 49/342
5,765,308 A 6/1998 Anderson et al.
5,937,582 A * 8/1999 Taylor ..... 49/341
6,122,863 A * 9/2000 Tippin et al. ..... 49/279

* cited by examiner

*Primary Examiner*—Blair M. Johnson
*Assistant Examiner*—Hugh B. Thompson
(74) *Attorney, Agent, or Firm*—McKee, Voorhees & Sease, P.L.C.

(57) ABSTRACT

A window opening and closing assembly capable of controlling an opening angle of the window effectively is disclosed. The assembly comprises a base with a groove along a longitudinal direction thereof, a slider inserted in the groove, an arm rotatably mounted on the base, a handle rotatably placed at a portion of the base and having a worm gear at an end thereof, a worm wheel meshing with the worm gear, and a switch for controlling the location of the slider. Wherein the slider has an angled side inwardly angled at a side of the first sliding portion thereof and the arm has a straight side for restricting a rotation angle thereof. Thus, an opening angle of a window can be controlled by an operation of the straight side and angled side.

7 Claims, 9 Drawing Sheets

WINDOW OPENING AND CLOSING ASSEMBLY

BACKGROUND OF THE INVENTION

1. Field of the Invention

The present invention relates to an opening and closing assembly for a window, and more particularly, to a window opening and closing assembly capable of controlling an opening angle of a window.

2. Background of the Invention

Windows are pivotally secured to a window frame to open and close the window. The window fits substantially within the window frame while closed and is rotated relative to the window frame so that it is not substantially within the window frame when open.

Here, window operators control the movement of the window between open and closed positions. The window operators may be classified into an automatic type and a manual type. The automatic type is operated by an operation of a motorized controller and the manual type is operated by a rotation of a handle by a user.

An example of a conventional manually operated window operator is disclosed in U.S. Pat. No. 5,765,308.

As shown in FIG. 7, the conventional manually operated window operator comprises a base 100 fixed on a window frame, a cover 200 attached to the base 100, an arm 400 having gear teeth 410 at a portion of the circumference thereof and rotatably mounted on the base 100, and a handle 500 having a worm gear 510 at an end thereof and meshing with the gear teeth 410 of the arm 400.

The conventional window operator opens or closes the window by an operation of the handle 500 by a user. That is, rotational force transferred via the handle 500 is transferred to the arm 400 via the worm gear 510, and then the window opens or closes as the arm 400 rotates.

However, the conventional window operator cannot control an opening angle of the window effectively.

SUMMARY OF THE INVENTION

Accordingly, it is an object of the prevent invention to provide an opening and closing assembly for window capable of controlling an opening angle of the window effectively.

In order to achieve the above object, the window opening and closing assembly comprises a base having a groove along a longitudinal direction thereof, a cover being attached to the base; a slider inserted in the groove and sliding along the groove; an arm rotatably mounted on the base, the rotation angle thereof being restricted by an operation of the slider; a handle rotatably placed at a portion of the base and having a worm gear at an end thereof; a worm wheel fixed on the upper surface of the arm and meshing with the worm gear; and a switch for controlling the location of the slider, the switch installed at the cover.

The groove has first guide groove and second guide groove formed in parallel to each other. Also, the slider comprises a first sliding portion inserted into the first guide groove and protruding from the upper surface of the base, and a second sliding portion inserted into the second guide groove and protruding from the upper surface of the base. The second sliding portion is integrally formed at a right angle at an end of the first sliding portion.

The slider has an angled side inwardly angled at a side of the first sliding portion thereof, and the arm has a straight side for restricting a rotation angle thereof. The straight side comes in contact with the angled side.

The second sliding portion of the slider has a guide gap and a receiving groove formed on the bottom surface thereof. The switch is inserted into the guide gap.

The arm has a partially circular end that has a straight side at a portion of a circumference thereof and an elongated end extending from a portion of the partially circular end. The partially circular end is rotatably mounted on the base.

Preferably, the slider is inserted into the first and second guide grooves and protrudes from the base to the substantial thickness of the partially circular end of the arm.

The switch comprises a knob which has a knob shaft rotatably inserted into an inserting aperture of the cover and a rotating member which is fixed to the knob shaft. The rotating member has an inserting protrusion inserted into a guide gap of the slider.

Also, the cover has two switch grooves around the inserting aperture thereof, and the switch further comprises a first fixing member inserted into the knob shaft of the knob. The first fixing member has a switch pin on a bottom surface thereof that is selectively inserted into the switch groove.

An elastic member can be placed between the knob and the first fixing member in order to apply an elastic force to the first fixing member.

BRIEF DESCRIPTION OF DRAWINGS

The invention is illustrated diagrammatically in the following drawings wherein.

DETAILED DESCRIPTION OF THE PREFERRED EMBODIMENT

Figure 1:
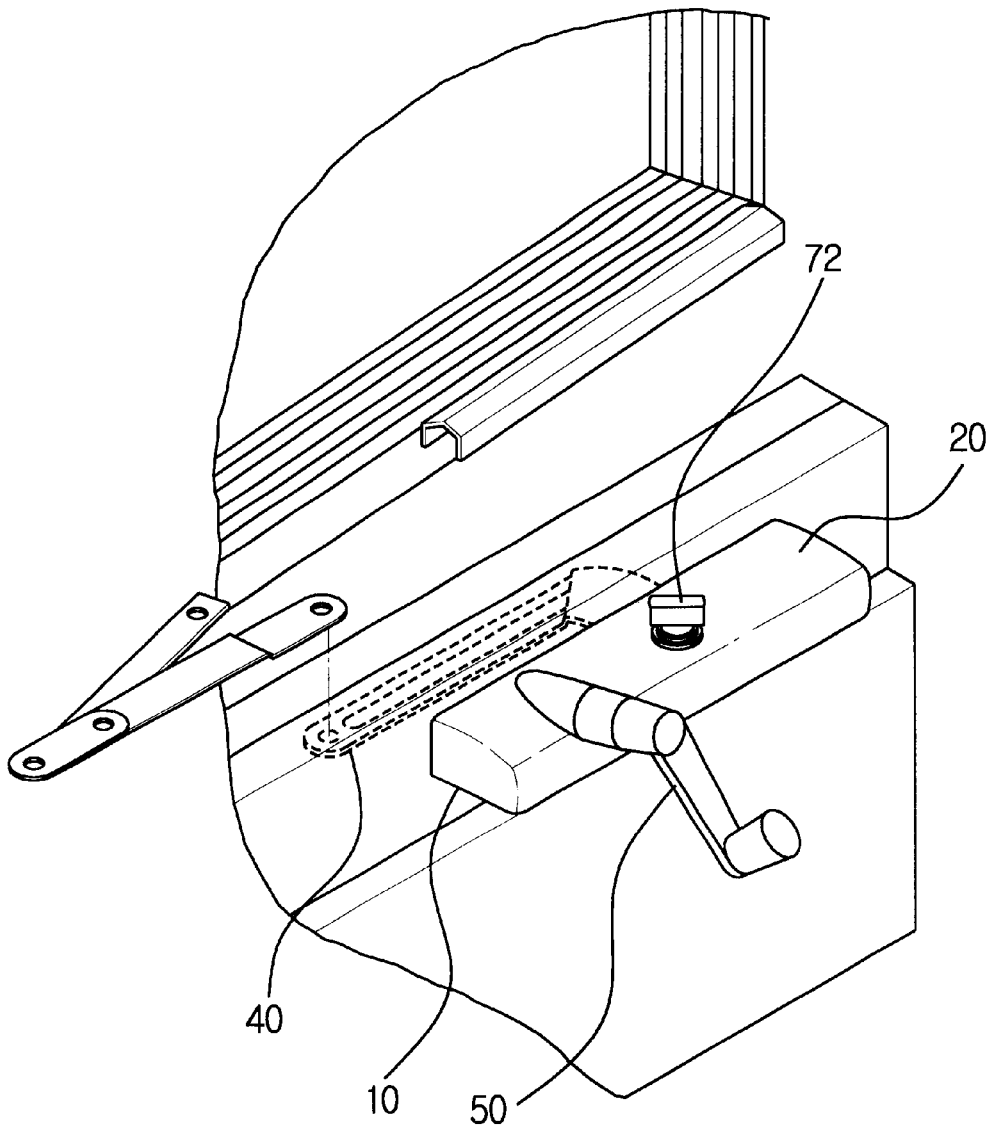
FIG. 1 is a perspective view of a window opening and closing assembly according to an embodiment of the present invention fixed on the window frame.

Hereinafter, concrete characteristics and advantages of the present invention will become more apparent with a detailed description of a preferred embodiment with reference to the accompanying drawings.

Referring now to the drawings, like reference characters designate like or corresponding parts throughout the several views.

Referring now to FIG. 1, the window opening and closing assembly according to an embodiment of the present invention comprises a base 10, a cover 20, a slider 30, an arm 40, a handle 50, a worm wheel 60, and a switch 70.

The base 10 is fixed on a window frame. First and second guide grooves 12*a*, 12*b* are formed in parallel on a surface of the base 10 along the longitudinal direction thereof. The first and second guide grooves 12*a*, 12*b* are connected to a main groove 12*c*. Also, the first and second guide grooves 12*a*, 12*b* are divided by a guide partition 14.

A tubular housing 16 integrally protrudes from the other surface of the base 10, and has an upwardly angled first aperture 18. A base aperture 15 is formed at a central portion of the base 10 in order to rotatably mount the arm 40 thereon.

The cover 20 is attached to the base 10. A tubular housing receiver 22 protrudes from a surface of the cover 20. The tubular housing receiver 22 has a second aperture 24 corresponding to the first aperture 18. An inserting aperture 26 in which the switch 70 is inserted is formed at the cover 20. Two switch grooves 28 are formed around the inserting aperture 26.

The slider 30 has a first sliding portion 32 and a second sliding portion 34 that are inserted into the first guide groove 12*a* and a second sliding portion 34, respectively, while protruding from the upper surface of the base 10.

The first sliding portion 32 has an angled side 33 inwardly angled at an end thereof at a predetermined angle. The second sliding portion 34 is integrally formed at an end of the first sliding portion 32 at a right angle, and consists of a pair of members spaced from each other.

A guide gap 35 is formed between the pair of the second sliding portion 34 and open to a side thereof. Also, a receiving groove 36 in which the guide partition 14 is inserted is formed on a lower surface of the second sliding portion 34. The slider 30 isn't easily bent and broken because the second sliding portion 34 slides while being guided along the guide partition 14.

Figure 4:
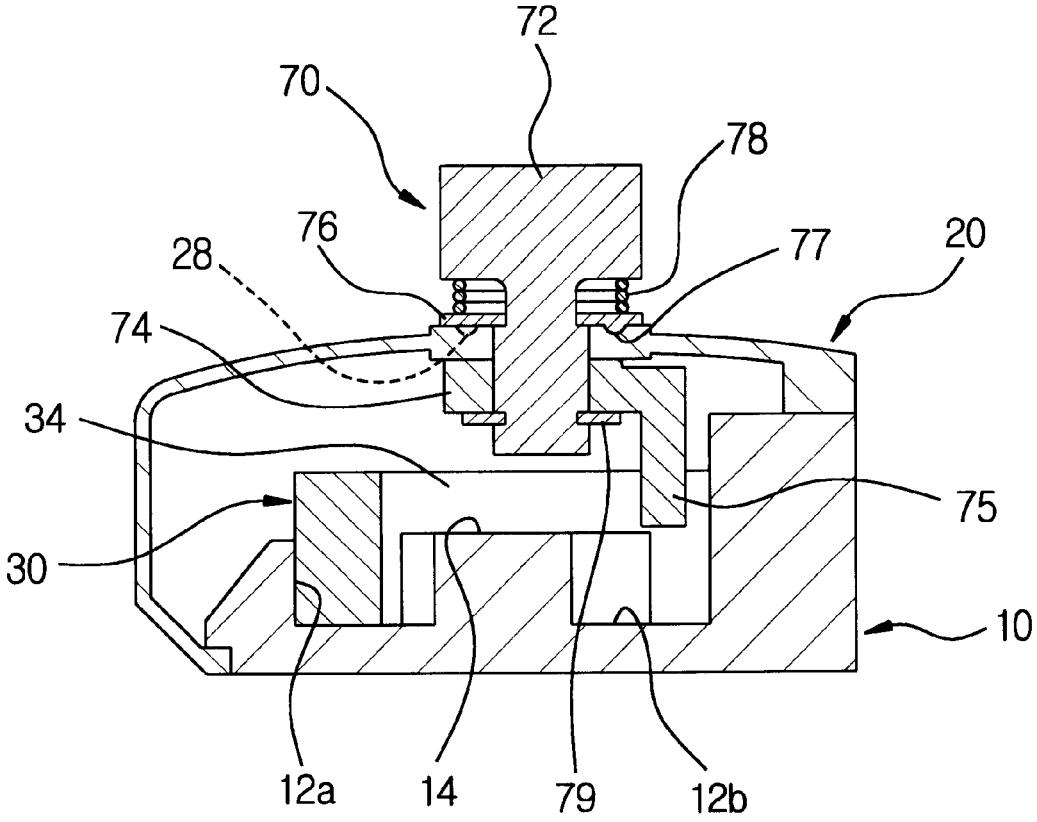
FIG. 4 is a vertical sectional view of the window opening and closing assembly taken substantially along line A—A in FIG. 2.

As shown in FIG. 4, preferably, the width of the first sliding portion 32 is constructed to be narrower than that of the first guide groove 12*a*, and the width of a contact area of the second sliding portion 34 is constructed to be narrower than that of the second guide groove 12*b*. Therefore, the contact area between the slider 30 and the first and second guide grooves 12*a*, 12*b* is reduced, and thus friction loss decreases.

The arm 40 is composed of a partially circular end 42 and an elongated end 46 extending from a portion of the circular end 42.

The circular end 42 is substantially half-round. The partially circular end 42 has a straight side 43 at a portion of the circumference thereof and an arm aperture 45 at a center portion thereof. Also, a plurality of fixing protrusions protrude from the upper surface of the partially circular end 42 in order to fix firmly the worm wheel 60 to the partially circular end 42.

The straight side 43 cooperates with the angled side 33, and thus controls the rotation of the arm 40. That is, when the straight side 43 comes in contact with the angled side 33 of the slider 30, the rotation of the arm 40 is restricted. In other words, the window is maintained in a partially open position.

The partially circular end 42 is rotatably mounted through the base aperture 15 using fasteners, such as rivets. The elongated end 46 is connected to a link connected to a window.

Preferably, the slider 30 is inserted in the first and second guide groove 12*a*, 12*b* while protruding from the base 10 to the substantial thickness of the partially circular end 42 of the arm 40, so that the straight side 43 comes in contact with the angled side 33 effectively.

The handle 50 has a handle shaft 54 inserted into the first aperture 18 of the tubular housing 16. A worm gear 52 is formed at an end of the handle shaft 54. A rotational force transferred through the handle 50 is transferred to the arm 40 via the worm gear 52 and the worm wheel 60, and thus a window opens or closes.

The worm wheel 60 has teeth on its outer surface, and has a plurality of fixing grooves 62 in which the fixing protrusions 44 of the arm 40 being fitted are formed on the upper surface thereon. The worm wheel 60 is fixed on the partially circular end 42 of the arm 40 and meshed with the worm gear 52.

The switch 70 comprises a knob 72, a rotating member 74, a first fixing member 76, an elastic member 78, and a second fixing member 79.

The knob 72 has a knob shaft 73 that is rotatably inserted into the inserting aperture 26 of the cover 20. The rotating member 74 has an inserting protrusion 75 downwardly protruding from the rotating member 74. The inserting protrusion 75 is inserted into the guide gap 35 of the second sliding portion 34 and moves the slider 30. The first fixing member 76 has a switch pin 77 that is selectively inserted into the switch groove 28 of the cover 20.

In order to install the switch 70, a user inserts the knob shaft 73 of the knob 72 into central holes of the elastic member 78 and the first fixing member 76, and then inserts it through the inserting aperture 26 of the cover 20. The user fixes the rotating member 74 to the knob shaft 73 using the second fixing member 79.

The user can control an opening angle of a window by turning the knob 72. That is, the switch pin 77 is selectively inserted into the switch grooves 28, and thus partially open or completely open modes are set. Here, the elastic member 78 elastically supports the first fixing member 76.

The window opening and closing assembly described above is operated as follows.

Figure 2:
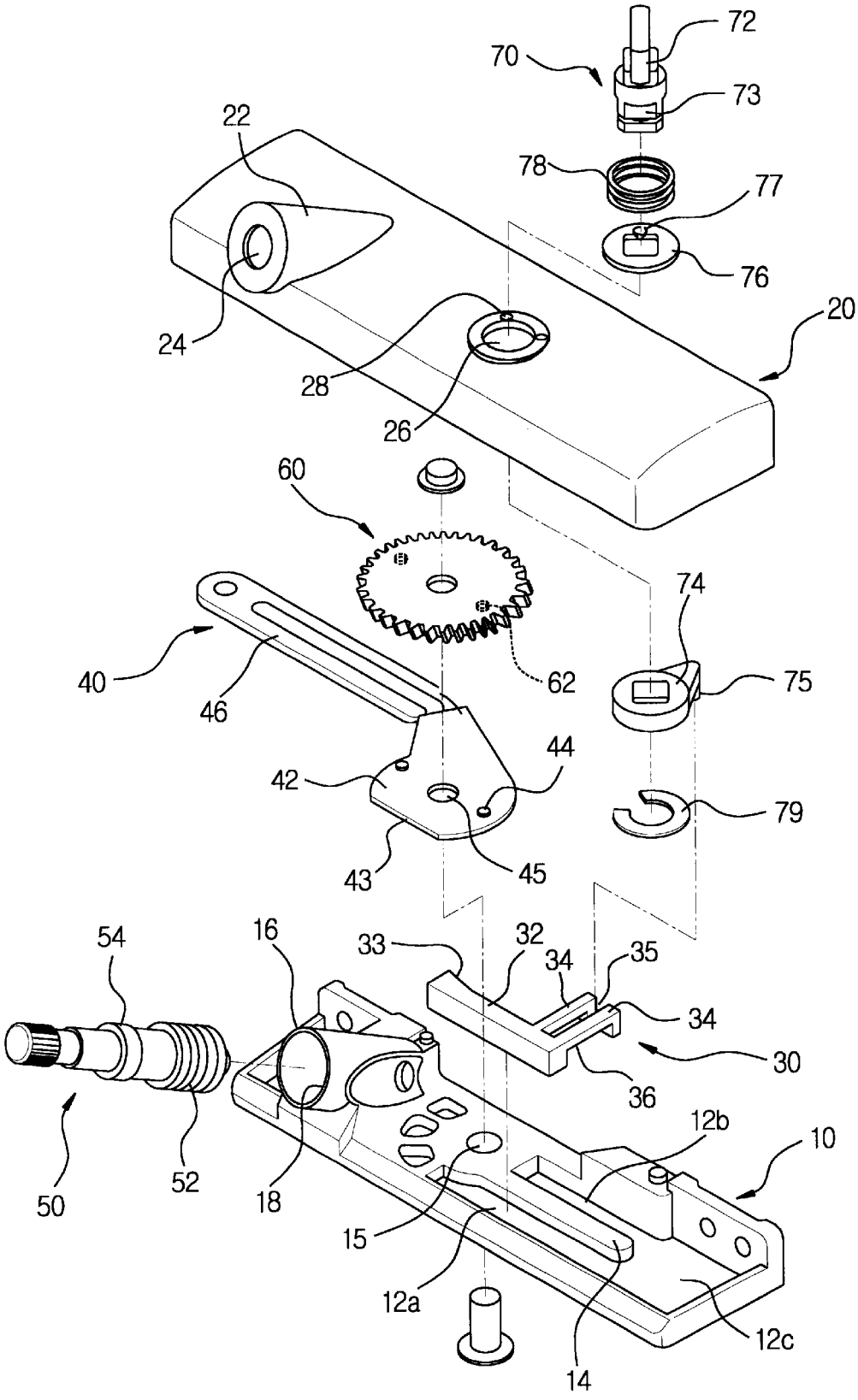
FIG. 2 is an exploded view of a window opening and closing assembly according to an embodiment of the present invention.
Figure 3:
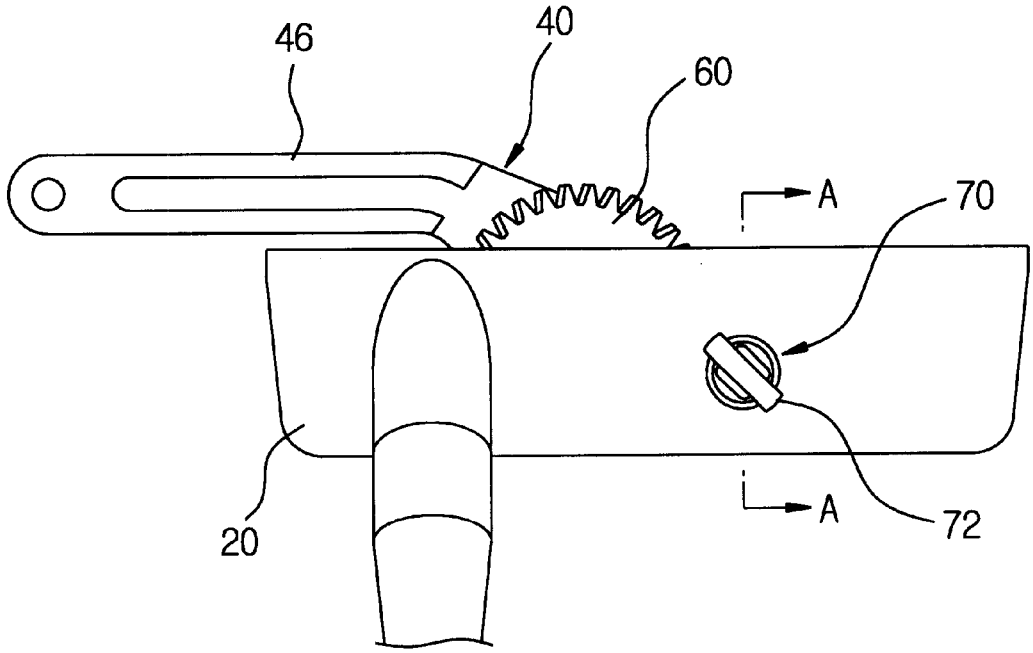
FIG. 3 is a plan view of the window opening and closing assembly in FIG. 2.
Figure 5:
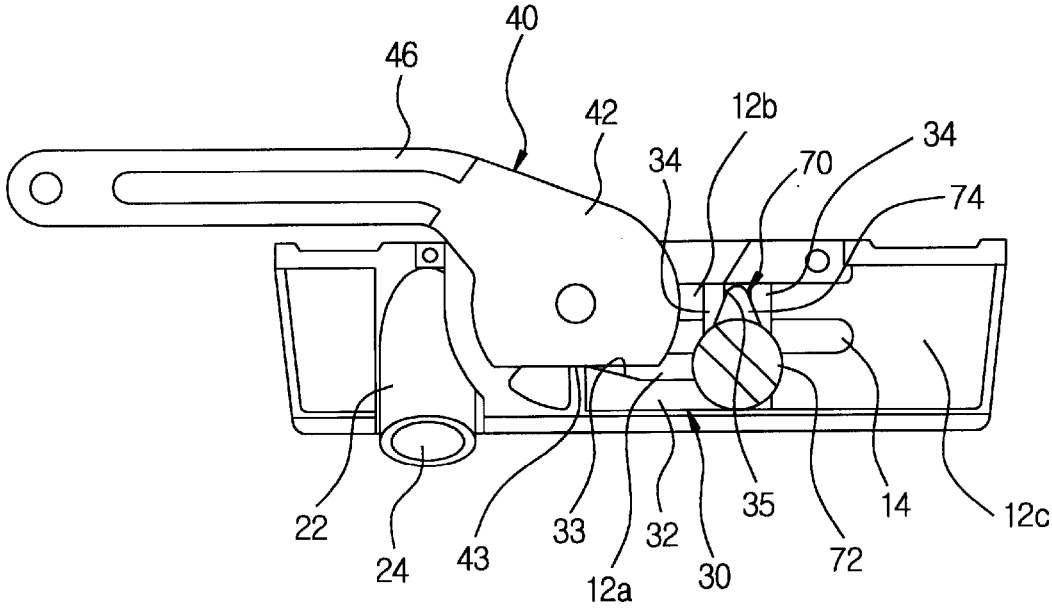
FIGS. 5 and 6 are views for showing an operational state of the window opening and closing assembly in FIG. 2 in "a partially open mode"
Figure 6:
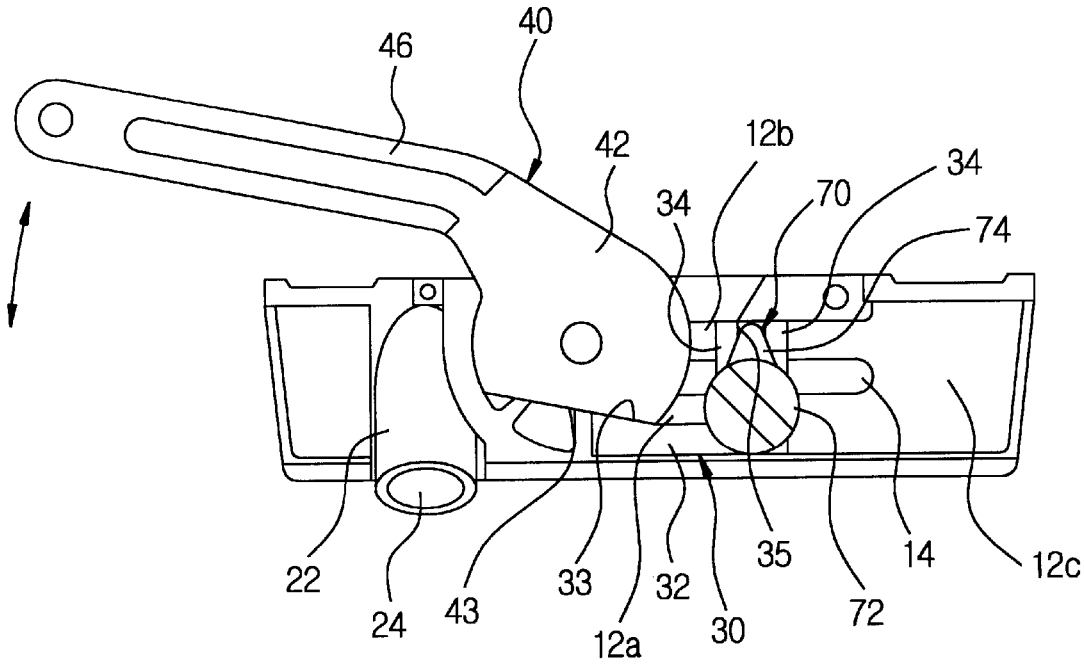

FIGS. 5 and 6 are views for showing an operational state of the window opening and closing assembly in FIG. 2 in "a partially open mode".

As shown in FIG. 5, in a partially open mode, the slider 30 comes in contact with an end wall of the first guide groove 12*a*. If a user turns the handle 50 in a counter-clockwise direction, the worm wheel 60 meshing with the worm gear 52 of the handle 50 rotates in a clockwise direction. Thus, the arm 40 fixed on the worm wheel 60 rotates in a clockwise direction, and then a window opens.

As shown in FIG. 6, if the straight side 43 of the arm 40 comes in contact with the angled side 33 of the slider 30 as the arm 40 rotates at a predetermined angle, the arm 40 does not rotate. That is, the angled side of the slider 30 stops the arm 40 rotating in a clockwise direction. Accordingly, the window partially opens.

On the contrary, if a user turns the handle 50 in a clockwise direction, the worm wheel 60 meshing with the worm gear 52 of the handle 50 rotates in a counter-clockwise direction. Thus, the arm 40 fixed on the worm wheel 60 rotates in a counter-clockwise direction, and a window completely opens.

Figure 7:
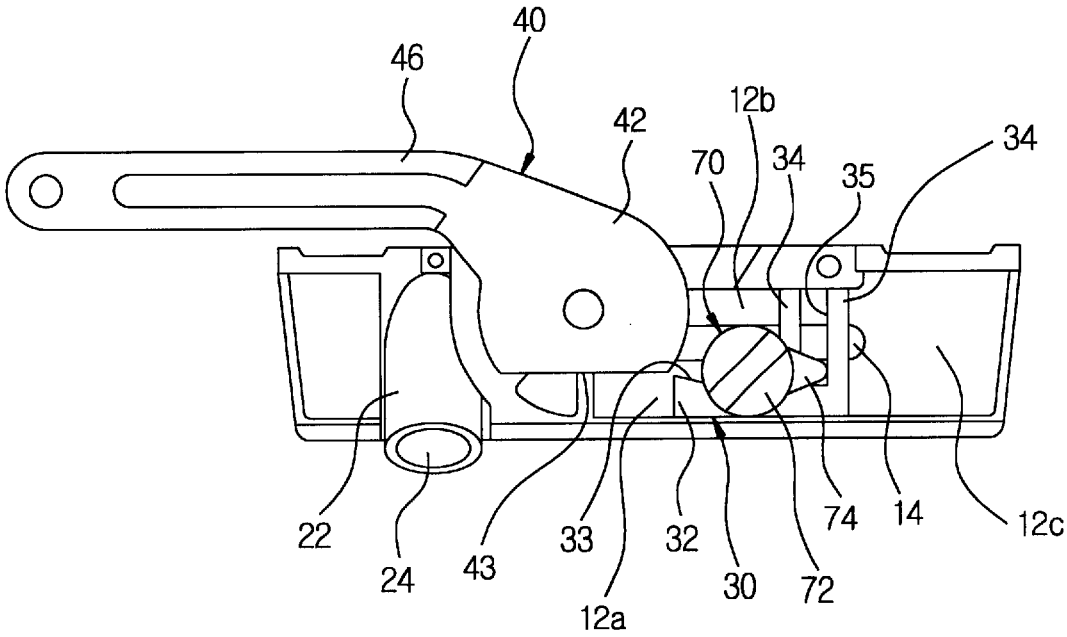
FIGS. 7 and 8 are views for showing an operational state of the window opening and closing assembly in FIG. 2 in "a completely open mode"
Figure 8:
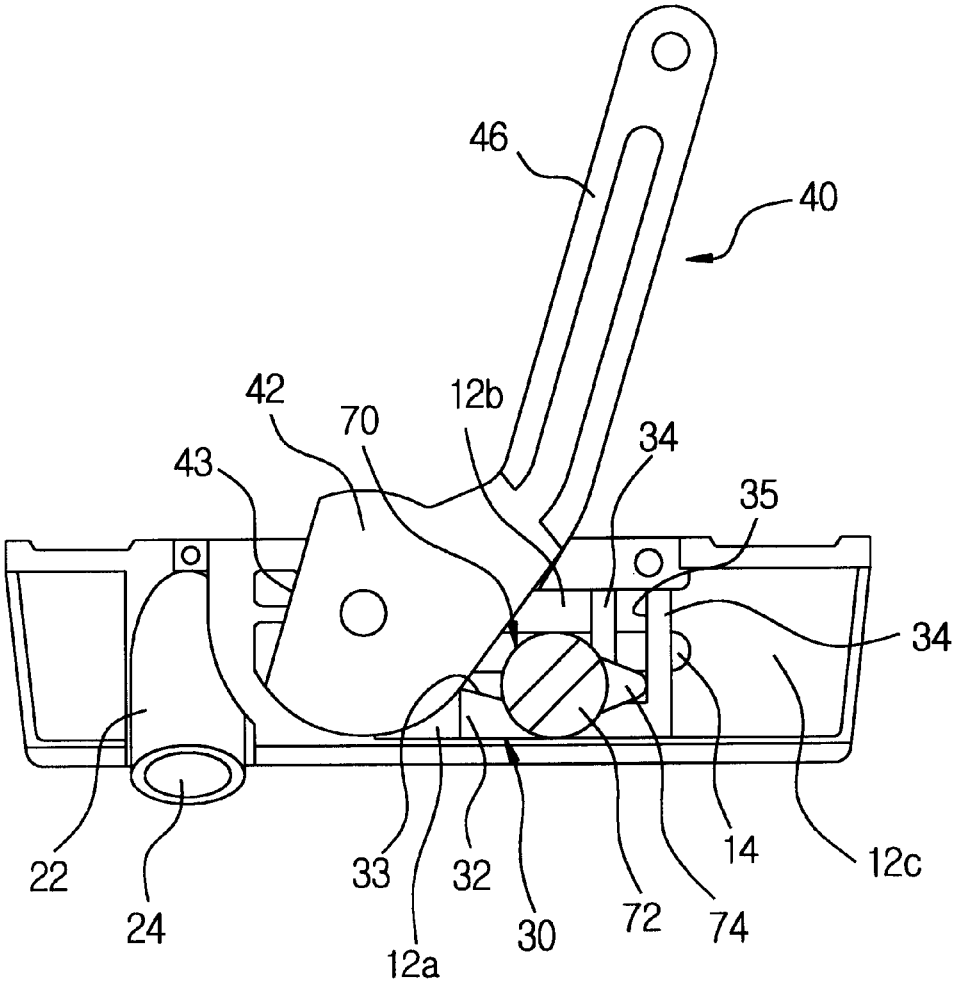
Figure 9:
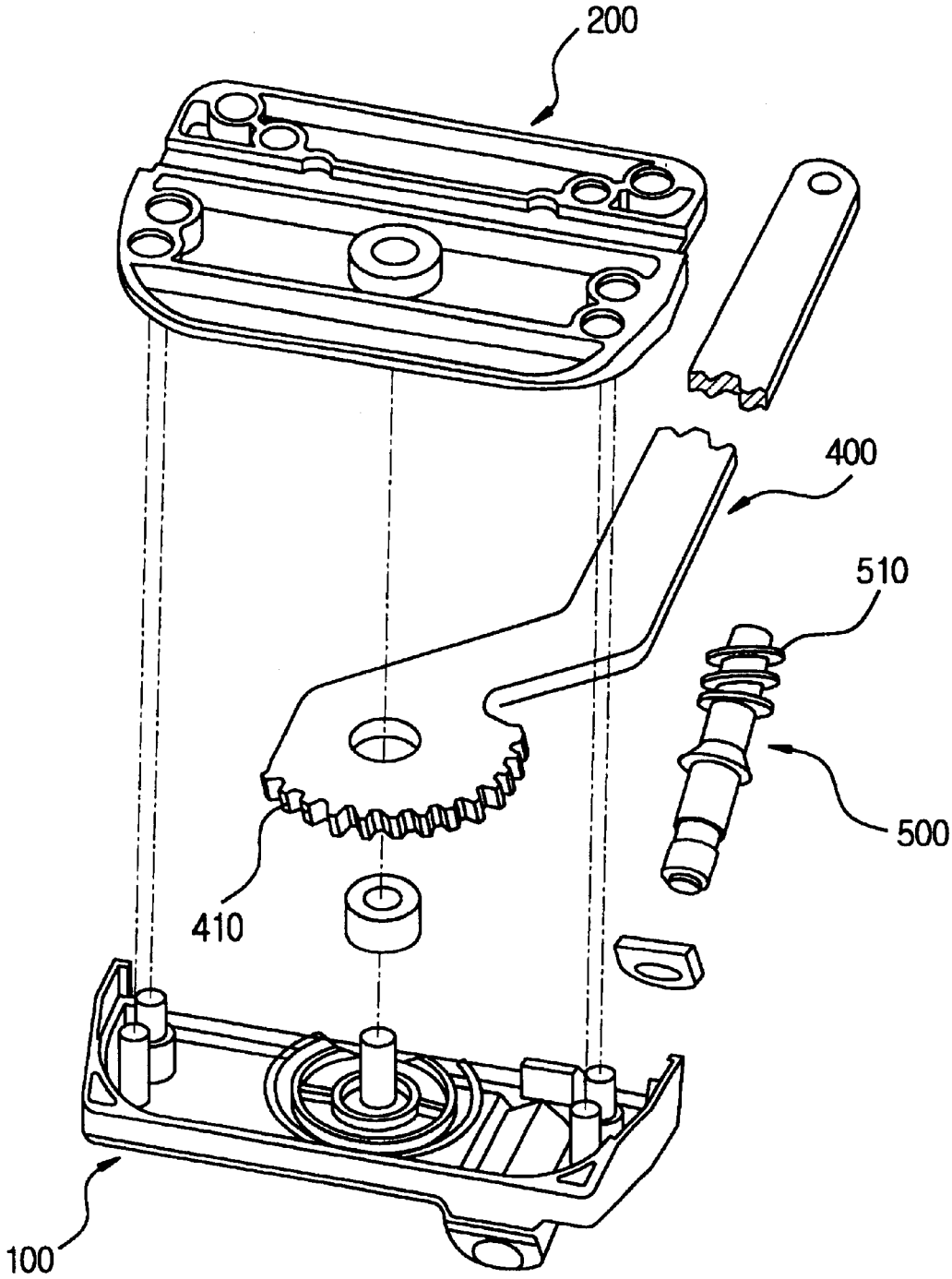
FIG.9 (PRIOR ART)
FIG. 9 is an exploded view of a conventional window opening and closing assembly.

FIGS. 7 and 8 are views for showing an operational state of the window opening and closing assembly in FIG. 2 in "a completely open mode".

As shown in FIG. 7, in a closed position, if a user turns the knob 72 in a clockwise direction, the rotating member 74 rotates in a clockwise direction. Thus, the inserting protrusion 75 of the rotating member 74 rotates along the guide gap 35 of the slider 30 and moves the slider 30 outwardly (in the direction of the arrow). The switch pin 77 of the first fixing member 76 is elastically inserted in the switch groove 28 of the cover 20 by an operation of the elastic member 78. That is, the switch 70 is switched to the completely open mode.

If a user turns the handle 50 in a counter-clockwise direction, the worm wheel 60 meshing with the worm gear 52 of the handle 50 rotates in a clockwise direction. Thus, the arm 40 fixed on the worm wheel 60 rotates in a clockwise direction, and then a window opens.

Contrary to the partially open mode, the angled side 33 of the slider 30 does not stop the arm 30 from rotating because the slider 30 escapes the radius of gyration of the partially circular end 42 of the arm 40. Therefore, the window completely opens without blocking.

The window opening and closing assembly described above can control an opening angle of a window effectively by a cooperation of the arm and the slider having a special shape.

Also, the assembly can effectively open or close a window even though dust enters therein because the contact area between the slider and the first and second guide groove is reduced.

Furthermore, the slider does not easily bend or break because it slides while being inserted into the guide partition.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claim are therefore intended to be embraced therein.

What is claimed is:

1. A window opening and closing assembly comprising:

a base having a guide groove along a longitudinal direction thereof, a cover being attached to the base;

a slider inserted in the guide groove and sliding along the groove, the slider having an angled side inwardly angled at a side thereof;

an arm having a partially circular end which has a straight side at a portion of a circumference thereof and is rotatably mounted on the base, and an elongated end extending from a portion of the partially circular end, a rotation angle of the arm being restricted because the straight side is stopped by engagement with the angled side;

a handle rotatably placed at a portion of the base and having a worm gear at an end thereof;

a worm wheel fixed on an upper surface of the arm and meshing with the worm gear; and a switch for controlling the location of the slider, the switch installed at the cover.

2. The window opening and closing assembly as claimed in claim 1, wherein the groove has a first guide groove and a second guide groove formed in parallel to each other, the slider comprises a first sliding portion inserted into the first guide groove and protruding from the upper surface of the base, and a second sliding portion inserted into the second guide groove and protruding from the upper surface of the base, the second sliding portion integrally formed at a right angle at an end of the first sliding portion.

3. The window opening and closing assembly as claimed in claim 2, wherein the second sliding portion of the slider has a guide gap and a receiving groove formed on the bottom surface thereof, the switch being inserted into the guide gap.

4. The window opening and closing assembly as claimed in claim 1, wherein the slider is inserted into the guide groove and protrudes from the base an amount substantially equal to the thickness of the partially circular end of the arm.

5. The window opening and closing assembly as claimed in claim 1, wherein the switch has a knob which has a knob shaft rotatably inserted into an inserting aperture of the cover and a rotating member which is fixed to the knob shaft, the rotating member having an inserting protrusion inserted into a guide gap of the slider.

6. The window opening and closing assembly as claimed in claim 1, wherein the cover has two switch grooves around the inserting aperture thereof, and the switch further comprises a first fixing member inserted into the knob shaft of the knob, the first fixing member having a switch pin on a bottom surface thereof which is selectively inserted into the switch groove.

7. A window opening and closing assembly as claimed in claim 6, further comprising an elastic member which is placed between the knob and the first fixing member and applies an elastic force to the first fixing member.

* * * * *